US009565960B2

(12) United States Patent
Gerard

(10) Patent No.: US 9,565,960 B2
(45) Date of Patent: Feb. 14, 2017

(54) MAILBOX COMPRISING TWO COMPARTMENTS

(71) Applicant: Noel Gerard, Jouars Pontchartrain (FR)

(72) Inventor: Noel Gerard, Jouars Pontchartrain (FR)

( * ) Notice: Subject to any disclaimer, the term of this patent is extended or adjusted under 35 U.S.C. 154(b) by 0 days.

(21) Appl. No.: 15/004,117

(22) Filed: Jan. 22, 2016

(65) Prior Publication Data

US 2016/0213185 A1 Jul. 28, 2016

(30) Foreign Application Priority Data

Jan. 22, 2015 (FR) ..... 15 00126

(51) Int. Cl.

| | |
|---|---|
| ***A47G 29/122*** | (2006.01) |
| ***A47G 29/20*** | (2006.01) |
| ***A47G 29/12*** | (2006.01) |
| ***A47G 29/124*** | (2006.01) |
| ***A47G 29/16*** | (2006.01) |

(52) U.S. Cl.

CPC ..... *A47G 29/1209* (2013.01); *A47G 29/12* (2013.01); *A47G 29/124* (2013.01); *A47G 29/16* (2013.01); *A47G 29/20* (2013.01)

(58) Field of Classification Search

CPC A47G 29/1209; A47G 29/124; A47G 29/141; A47G 2029/148; A47G 29/20; A47G 29/12; A47G 29/16; B65D 55/14; E05B 63/143; E05B 65/0003; E05C 7/00; E05C 19/10

USPC ..... 232/17, 24, 25, 44, 45; 340/569; 70/63, 70/160; 292/107

See application file for complete search history.

(56) References Cited

U.S. PATENT DOCUMENTS

| | | | | |
|---|---|---|---|---|
| 4,865,248 | A * | 9/1989 | Barth | A47G 29/20 232/24 |
| 6,719,195 | B2 * | 4/2004 | Farentinos | A47G 29/22 232/45 |
| 6,799,716 | B1 * | 10/2004 | Kuelbs | G09F 27/007 232/17 |
| 7,320,427 | B2 * | 1/2008 | Prestwich | A47G 29/22 232/45 |
| 7,337,944 | B2 * | 3/2008 | Devar | A47G 29/141 232/19 |
| 7,607,569 | B2 * | 10/2009 | Van Rossum | A47G 29/1209 232/20 |
| 2002/0162883 | A1 * | 11/2002 | Arvonio | G07B 17/00193 232/45 |

(Continued)

FOREIGN PATENT DOCUMENTS

FR 2 516 581 A1 5/1983

OTHER PUBLICATIONS

French Search Report (FR 1500126) (2 pages—dated Nov. 10, 2015).

*Primary Examiner* — William Miller
(74) *Attorney, Agent, or Firm* — Renner, Kenner, Greive, Bobak, Taylor & Weber

(57) ABSTRACT

Mailbox comprising at least two compartments, a first compartment for receiving letters and a second compartment for receiving packages, each compartment comprising a respective access door, first locking means being provided for locking the door of the first compartment and second locking means being provided for locking the door of the second compartment, wherein the arrangement is such that the unlocking of the door of the second compartment locked by the second locking means is made by the unlocking of the door of the first compartment locked by the first locking means.

14 Claims, 1 Drawing Sheet

(56) References Cited

U.S. PATENT DOCUMENTS

2009/0084836 A1 4/2009 Dudley

* cited by examiner

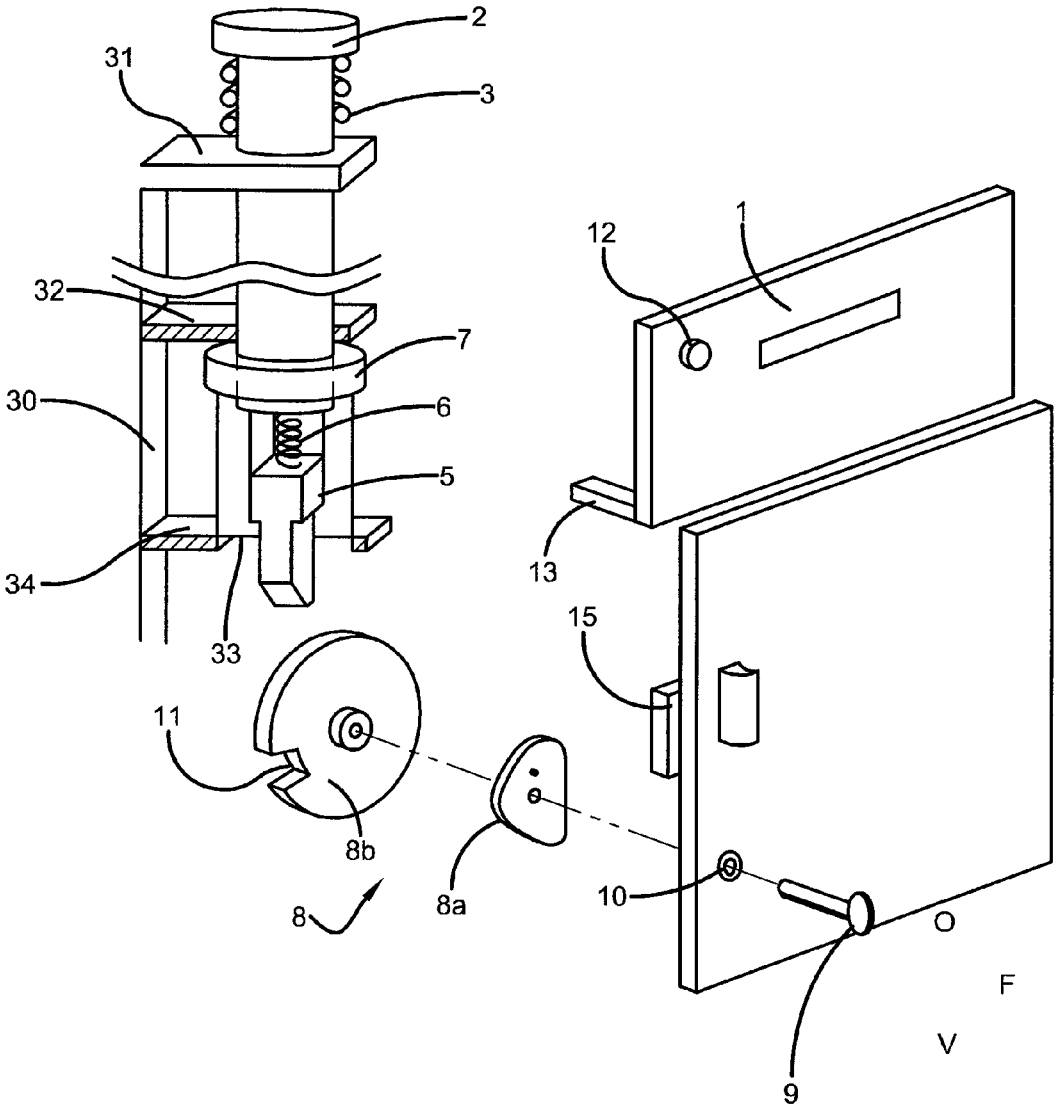
2
31
3
12
1
32
7
30
6
5
13
34
33
15
11
8b
8a
10
8
O
F
V
9

MAILBOX COMPRISING TWO COMPARTMENTS

TECHNICAL FIELD

The present invention relates to a mailbox, comprising at least two compartments, a first compartment for the reception of letters or packages of small dimensions or sizes, in particular of small thicknesses, and a second compartment for the reception of packages of larger dimensions or sizes, in particular of larger thicknesses, each compartment having a respective access door.

BACKGROUND ART

It is already known in the prior art mailboxes having two compartments, for example in US patent application 2009/0084836. The two compartments each have an access door and a respective distinct lock. Furthermore, a trap door allows passage between the two compartments, the trap door opening itself when the door of the first compartment has been opened and closed again in succession. The user(s), in particular the owner and the postman, in order to have access to the two compartments, operate(s) each lock independently of the other, so as to have access to the compartments. Also, only the registered courier companies having a master key, for example the Post Office, can deposit packages.

DISCLOSURE OF THE INVENTION

The present invention aims to provide a mailbox in which any deliveryman may deposit a package in the dedicated compartment without needing the key or of a key allowing the unlocking of the lock of the package compartment, while at the same time allowing the closing and the locking of the package compartment once the package has been deposited but allowing the owner of the mailbox to collect his letters and packages with the use of a single key.

As per the present invention, a mailbox comprising two compartments, one for receiving letters and the other for packages of larger sizes, notably of larger thicknesses, each compartment comprising a respective access door, first locking means being provided for locking the door of the first compartment and second locking means being provided for locking the door of the second compartment, is characterized in that the arrangement is such that the unlocking of the second locking means is made during the unlocking of the first locking means.

Consequently, when the deliveryman comes for depositing letters and more voluminous packages, he introduces the letters in the previously locked first compartment, in particular through a slit of small thickness made in the door of the first compartment (classical compartment of a mailbox) and places the packages in the second compartment, the door thereof being previously open or closed but unlocked. He then closes the door of the second compartment and locks it. When the owner comes to take his letters and/or packages, he unlocks the door of the first compartment in which the letters are present, the system being arranged so that this unlocking also triggers the unlocking of the door of the second compartment, so as to give access to the packages, and this even though the owner only have a single key allowing the unlocking of the mailbox as a whole.

In a preferred embodiment of the present invention, the locking means of the door of the second compartment for packages can take three states, one in which the door is opened, one in which the door is closed but unlocked, and one in which the door is closed and locked.

The deliveryman, in front of the mailbox with the door of the second compartment in the closed but unlocked state, can open it to deposit the package and then close it in the locked state.

As per a feature of the present invention, in the locked state, the device can no longer be operated, in particular manually, to make it pass in the closed or opened states, except by the unlocking of the first door leading to the unlocking of the second door.

BRIEF DESCRIPTION OF THE DRAWINGS

Embodiments of the present invention are described in the following description, only as an example, in reference to the appended drawings, in which the only FIGURE is a partially exploded perspective view of a first embodiment of a mailbox of the present invention.

PREFERRED EMBODIMENT FOR CARRYING OUT THE INVENTION

As shown in the FIGURE, the mailbox comprises a first compartment for letters of small thicknesses and a second compartment for packages of larger thicknesses. There is provided a first door 1 for gaining access to the first compartment from the outside and a second door 10 for gaining access to the second compartment from the outside. In the door 1 is formed a slit having a limit thickness allowing the passage for letters of small thicknesses but not for packages of larger thicknesses.

The door 1 for gaining access to the letters compartment is fitted with a specific profile in the form of a projection 13 fixed to the door 1 and projecting inside the compartment perpendicularly to the plane of the door 1. The device comprises a control axis 2 in the form of a stem, a return spring 3, a keeper 5, a spring 6, a keeper guide 7 fixed to the control axis 2, a bolt 8, made of a profile or cam **8*a* for opening/closing of the door and of a profile or cam 8*b* for the locking of the door, fixed in rotation with the cam 8*a* for opening/closing of the door and a lever or handle 9** for manual control.

The door 10 for gaining access to the package compartment comprises a lug 15 taking part in the opening and/or closing of the door 10. The keeper guide 7, fixed to the axis 2, is guided through an opening 33 made in a plate 34 projecting laterally of the lateral wall 30 in the second compartment. Also, the movement of the keeper guide 7 is limited in the upward direction by a upper plate 32 projecting laterally from the lateral wall 30 in the second compartment, at a distance from the plate 34. In the keeper guide 7, a keeper 5 is movably guided while urged downwards by the spring 6.

Furthermore, there are provided locking means for the first door 1, for example a classical key lock 12.

An upper part of the control axis 2 extends itself in the first compartment below the projection 13. The axis 2 goes through the floor 31 of the first compartment so as to extend in the second compartment to cooperate with the bolt 8.

In a first state (F), closed but unlocked, the door 1 for letters of small sizes is closed and locked by its corresponding locking means. The projection 13 rests again the upper end of the control axis 2 by pushing the latter downwards against the spring 3 which bears against the floor 31, the axis 2 in the shape of a stem passing through the floor 31 between the two compartments respectively for letters and packages.

The cam 8*a*, fixed in rotation with said cam 8*b*, is controlled in rotation with the handle 9 and the corresponding axis of the handle 9, the handle 9 and the two cams 8*a* and 8*b* being fixed in rotation together. The cam 8*a* cooperates with the lug 15. The cam 8*b* cooperates with the keeper 5 at the lower end of the axis 2.

In the opened state (O), the lug 15 is not blocked by the cam 8*a*, the latter having its rectilinear profile on the side of the lug 15, so that the cam 8*a* cannot interpose itself between the door 10 and the lug 15. In the closed position, the cam 8*a*, through a 90° rotation, has come in interposition between the lug 15 and the door 10.

Starting from the closed state, the deliveryman rotates the handle 9 from the closed state (F) to the opened state (O), which has the effect of pivoting the cam 8*a* to free the lug 15 and allow opening of the door. The door 10 is opened and the deliveryman can deposit the package and then close again the door and rotate the handle 9 by 180° up to the locked state (V) in which on one part the cam 8*a* is blocking the lug 15 and on another part the cam 8*b* has pivoted sufficiently so that the keeper 5 has come into the slot 11 under the action of the spring 6. The door 1 being closed and the projection 13 pressing against the axis 2, the keeper 5 is pressed inside the slot 11 and cannot exit therefrom. The rotating of the handle 9 is then no more possible and the door 10 is closed and locked. The opening through a key or an equivalent means of the letter compartment moves apart the door 1 and frees the axis 2 of the pressure exerted by the projection 13. The spring 3 pushes back the axis 2 upwards, moving also upwards the keeper 5 which exits from the slot 11. The handle 9 can again be operated and can be placed in the opened state or the closed but unlocked state and the access to the compartment can be gained for the owner of the mailbox who can therefore gain access to both its letters and packages.

What is claimed is:

1. Mailbox comprising at least two compartments, a first compartment for receiving letters and a second compartment for receiving packages, each compartment comprising a respective access door, first locking means being provided for locking the door of the first compartment and second locking means being provided for locking the door of the second compartment, wherein the arrangement is such that the unlocking of the door of the second compartment locked by the second locking means is accomplished by the unlocking of the door of the first compartment locked by the first locking means, wherein said second locking means comprises a control axis on which presses a projection of the first door, a retractable keeper and a blocking cam comprising a slot for receiving of the keeper in the locked state, said cam pressing on the keeper till said keeper engages itself in said slot so as to lock said second locking means, the opening of the first door having the effect to let said axis go upwards and let the keeper exit the slot and unlock said second locking means.

2. Mailbox as defined in claim 1, wherein said second locking means comprise a spring, said cam pressing said spring against said axis till said keeper engages itself into said slot.

3. Mailbox as defined in claim 2, wherein said second locking means comprise a keeper guide fixed to said axis.

4. Mailbox as defined in claim 1, wherein said second locking means comprise a keeper guide fixed to said axis.

5. Mailbox as defined in claim 1, wherein said projection of the door of said first compartment moves said axis in a lower position during the closing of the door of the first compartment.

6. Mailbox as defined in claim 1, characterized in that said second locking means includes a control lever having an axis for rotating said cam.

7. A mailbox comprising at least two compartments, a first compartment adapted to receive letters and a second compartment adapted to receive packages, each said compartment having an access door, locking means for locking said door of said second compartment, such that the opening of said door of said first compartment unlocks said locking means so that said door of said second compartment can be opened.

8. The mailbox of claim 7 wherein said first door is provided with a slit for the introduction of letters into said first compartment.

9. The mailbox of claim 8, wherein said locking means includes a control axis, on which presses a projection of said door of said first compartment, a retractable keeper and a blocking cam including a slot for receiving of the keeper in the locked state, said cam pressing on said keeper until said keeper engages itself in said slot so as to lock said locking means, the opening of said door of said first compartment having the effect to let said axis go upwards and let the keeper exit the slot of unlock said locking means.

10. The mailbox of claim 9, wherein said locking means includes a spring, said cam pressing said spring against said axis until said keeper engages itself into said slot.

11. The mailbox of claim 10, wherein said locking means includes a keeper guide fixed to said axis.

12. The mailbox of claim 9, wherein said locking means includes a keeper guide fixed to said axis.

13. The mailbox of claim 9, wherein said projection of said door of said first compartment moves said axis in a lower position during the closing of said door of the first compartment.

14. The mailbox of claim 9, further comprising a control lever having an axis for rotating said cam.

* * * * *